US011073329B2

(12) United States Patent
Kumar et al.

(10) Patent No.: US 11,073,329 B2
(45) Date of Patent: Jul. 27, 2021

(54) REFRIGERATOR SHELVING FRAME WITH SNAP-IN SLIDING INSERT

(71) Applicant: WHIRLPOOL CORPORATION, Benton Harbor, MI (US)

(72) Inventors: Shrawan Kumar, St. Joseph, MI (US); Pranav, St. Joseph, MI (US); Kundan S. Rawate, Maharashtra (IN); Abhijeet Suryavanshi, Bidar (IN)

(73) Assignee: Whirlpool Corporation, Benton Harbor, MI (US)

( * ) Notice: Subject to any disclaimer, the term of this patent is extended or adjusted under 35 U.S.C. 154(b) by 43 days.

(21) Appl. No.: 16/176,484

(22) Filed: Oct. 31, 2018

(65) Prior Publication Data

US 2020/0132360 A1 Apr. 30, 2020

(51) Int. Cl.
*F25D 25/02* (2006.01)
*A47B 96/02* (2006.01)

(52) U.S. Cl.
CPC ..... *F25D 25/024* (2013.01); *A47B 96/021* (2013.01)

(58) Field of Classification Search
CPC ..... F25D 25/024; A47B 96/021
USPC ..... 312/295
See application file for complete search history.

(56) References Cited

U.S. PATENT DOCUMENTS 774,117 A 11/1904 Tandy
1,952,148 A 3/1934 Stout
1,997,432 A 4/1935 Replogle
2,065,391 A 12/1936 Nance
2,187,916 A 1/1940 Seeger
2,225,762 A 12/1940 Barnsteiner
2,282,342 A 5/1942 Preble
2,412,904 A 12/1946 Money et al.
2,434,117 A 1/1948 Money et al.
(Continued)

FOREIGN PATENT DOCUMENTS

BR PI0100491 B1 6/2009
BR 8802268 U2 2/2010
(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.
(Continued)

*Primary Examiner* — Daniel J Troy
*Assistant Examiner* — Timothy M Ayres
(74) *Attorney, Agent, or Firm* — Price Heneveld LLP

(57) ABSTRACT

A refrigerator shelf assembly includes a frame having a depth and a first support element extending along the depth and defining a first track open in a lateral direction perpendicular to the depth. The support element further defines a first open area along a first side of the track and extending between an adjacent portion of the track and an exterior of the first support element and a cantilever arm having a free end adjacent the first open area. The cantilever arm is resiliently deformable away from a plane defined along the first side of the track. The assembly further includes an insert slidably received within the track and moveable along the depth of the first track through a fixed range of motion, wherein the insert is disposed over an expanse of the first open area.

17 Claims, 7 Drawing Sheets

(56) References Cited

U.S. PATENT DOCUMENTS 2,466,360 A 4/1949 Bitney
2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,266,858 A 8/1966 Klotz
3,295,904 A 1/1967 Cobb
3,410,260 A 11/1968 Morgan
3,866,437 A 2/1975 Spencer
3,984,163 A 10/1976 Boorman, Jr. et al.
4,597,616 A 7/1986 Trubiano
4,638,644 A 1/1987 Gidseg
4,729,613 A 3/1988 Tromble et al.
4,732,435 A 3/1988 Bailey et al.
4,735,470 A 4/1988 Falk
4,834,557 A 5/1989 Dreinhoff
4,914,928 A 4/1990 Fellwock et al.
4,998,382 A 3/1991 Kostos et al.
5,088,801 A 2/1992 Rorke et al.
5,273,354 A 12/1993 Herrman et al.
5,340,209 A * 8/1994 Kolbe ..... F25D 25/024 312/334.46
5,362,145 A 11/1994 Bird et al.
5,411,165 A 5/1995 Ellis
5,415,472 A 5/1995 Brise
5,429,043 A 7/1995 Becker
5,447,146 A 9/1995 Nickerson
5,469,999 A 11/1995 Phirippidis
5,524,981 A 6/1996 Herrmann et al.
5,564,809 A 10/1996 Kane et al.
5,605,344 A 2/1997 Insalaco et al.
5,660,777 A 8/1997 Herrmann et al.
5,673,984 A 10/1997 Insalaco et al.
5,735,589 A 4/1998 Herrmann et al.
5,813,741 A 9/1998 Fish et al.
5,833,336 A 11/1998 Dean
5,918,959 A 7/1999 Lee
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,578,720 B1 6/2003 Wang
6,604,800 B2 8/2003 Hamilton
6,811,045 B1 11/2004 Masker et al.
D505,140 S 5/2005 Reed et al.
D516,100 S 2/2006 Vardon
D516,102 S 2/2006 Vardon
7,021,730 B2 4/2006 Remmers
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D547,640 S 7/2007 Remmers
D551,262 S 9/2007 Becke
7,270,385 B2 * 9/2007 Mathur ..... A47B 96/025 108/108
D551,884 S 10/2007 Remmers
7,367,571 B1 5/2008 Nichols
7,467,834 B2 12/2008 Kim et al.
7,497,533 B2 3/2009 Remmers
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
8,047,397 B2 11/2011 Mittet
D656,970 S 4/2012 Merritt
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 * 3/2013 Park ..... F25D 25/02 108/143
8,414,095 B2 4/2013 Stewart
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 * 7/2014 Amaral ..... F25D 25/024 312/408
D710,405 S 8/2014 Seo et al.
D710,406 S 8/2014 Seo et al.
D711,943 S 8/2014 Park et al.
8,814,287 B2 8/2014 Jang
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
9,033,438 B2 * 5/2015 Kelly ..... F25D 25/024 312/408
D734,784 S 7/2015 Kim et al.
9,097,457 B2 8/2015 Kim
9,103,582 B2 8/2015 Nash et al.
9,127,877 B2 * 9/2015 Lee ..... F25D 25/024
9,127,878 B2 9/2015 Gossens et al.
9,131,785 B2 9/2015 Peru
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
9,328,955 B2 5/2016 Castro Solis et al.
9,335,089 B1 5/2016 Gossens
9,339,993 B2 5/2016 Cites et al.
9,345,326 B2 5/2016 Sankhgond et al.
D761,884 S 7/2016 Austin et al.
9,453,673 B2 9/2016 Gossens
9,488,405 B2 11/2016 Lee et al.
9,500,403 B2 11/2016 Seo et al.
9,510,679 B2 12/2016 Bhatt et al.
9,574,820 B2 2/2017 Lee
9,593,879 B2 * 3/2017 Burke ..... A47B 96/025

(56) References Cited

U.S. PATENT DOCUMENTS

| | | | |
|---|---|---|---|
| 9,671,115 | B2 | 6/2017 | Elkasevic |
| 9,823,013 | B1 | 11/2017 | Caglin et al. |
| 9,861,200 | B2 | 1/2018 | Lim |
| 9,945,601 | B1 | 4/2018 | Bhaysar et al. |
| 2003/0020387 | A1 | 1/2003 | Wing et al. |
| 2004/0012314 | A1 | 1/2004 | Hay et al. |
| 2004/0104323 | A1 | 6/2004 | Hubert et al. |
| 2005/0073225 | A1 | 4/2005 | Kwon et al. |
| 2006/0042305 | A1 | 3/2006 | Oh et al. |
| 2006/0049731 | A1 | 3/2006 | Choi et al. |
| 2006/0145577 | A1 | 7/2006 | Daley et al. |
| 2006/0226749 | A1 | 10/2006 | Kim |
| 2006/0226751 | A1 | 10/2006 | Park |
| 2007/0113578 | A1 | 5/2007 | Wu et al. |
| 2007/0126325 | A1 | 6/2007 | Gorz et al. |
| 2007/0228904 | A1 | 10/2007 | Williams |
| 2007/0235397 | A1 | 10/2007 | Wannop |
| 2008/0203041 | A1 | 8/2008 | Lim et al. |
| 2008/0315743 | A1 | 12/2008 | Oh |
| 2009/0193836 | A1 | 8/2009 | Ertz et al. |
| 2010/0024464 | A1 | 2/2010 | Hwang et al. |
| 2010/0102693 | A1 | 4/2010 | Driver et al. |
| 2010/0109498 | A1 | 5/2010 | Ramm et al. |
| 2010/0219731 | A1 | 9/2010 | Candeo et al. |
| 2011/0001415 | A1 | 1/2011 | Park et al. |
| 2011/0072846 | A1 | 3/2011 | Engel et al. |
| 2011/0115356 | A1 | 5/2011 | Nash et al. |
| 2012/0018434 | A1 | 1/2012 | Gwak |
| 2012/0024006 | A1 | 2/2012 | Knoll et al. |
| 2012/0091084 | A1 | 4/2012 | Amaral et al. |
| 2012/0223038 | A1 | 9/2012 | Bean |
| 2012/0248958 | A1 | 10/2012 | Ertz et al. |
| 2013/0020922 | A1 | 1/2013 | Jang |
| 2013/0119846 | A1 | 5/2013 | Seo et al. |
| 2013/0147337 | A1 | 6/2013 | Lim |
| 2013/0219731 | A1 | 8/2013 | Zhang |
| 2014/0216095 | A1 | 8/2014 | Leclear et al. |
| 2014/0217044 | A1 | 8/2014 | Cole |
| 2015/0034668 | A1 | 2/2015 | Minard et al. |
| 2015/0061484 | A1 | 3/2015 | Jeong et al. |
| 2015/0068999 | A1 | 3/2015 | Dart et al. |
| 2015/0107084 | A1 | 4/2015 | Craycraft et al. |
| 2015/0168048 | A1 | 6/2015 | Sexton et al. |
| 2015/0184929 | A1 | 7/2015 | Moon |
| 2015/0351532 | A1 | 12/2015 | Peru |
| 2016/0067863 | A1 | 3/2016 | Cole |
| 2016/0290707 | A1 | 10/2016 | Burke et al. |
| 2017/0086580 | A1 | 3/2017 | Conti |
| 2017/0181538 | A1 | 6/2017 | Azkue et al. |
| 2017/0276425 | A1 | 9/2017 | Fink et al. |
| 2017/0341217 | A1 | 11/2017 | Cole |
| 2018/0127007 | A1 | 5/2018 | Kravchenko |

FOREIGN PATENT DOCUMENTS

| | | | |
|---|---|---|---|
| BR | PI0805999 | A2 | 6/2010 |
| CA | 1037908 | A | 9/1978 |
| CN | 1975301 | A | 6/2007 |
| CN | 101611281 | A | 12/2009 |
| CN | 201779952 | U | 3/2011 |
| CN | 102135363 | A | 7/2011 |
| CN | 102395849 | A | 3/2012 |
| CN | 102494496 | A | 6/2012 |
| CN | 202432813 | U | 9/2012 |
| CN | 102829604 | A | 12/2012 |
| CN | 102889744 | A | 1/2013 |
| CN | 203216196 | U | 9/2013 |
| CN | 101688748 | B | 12/2013 |
| CN | 103900317 | A | 7/2014 |
| CN | 104089457 | A | 10/2014 |
| CN | 104896859 | A | 9/2015 |
| CN | 205619680 | U | 10/2016 |
| CN | 205641793 | U | 10/2016 |
| CN | 205980510 | U | 2/2017 |
| CN | 106766627 | A | 5/2017 |
| DE | 8801508 | U1 | 6/1989 |
| DE | 700820 | T1 | 11/1996 |
| DE | 19750473 | A1 | 5/1999 |
| DE | 69519613 | T2 | 4/2001 |
| DE | 10107646 | A1 | 8/2002 |
| DE | 69529852 | T2 | 9/2003 |
| DE | 102009045363 | A1 | 4/2011 |
| DE | 102011003037 | A1 | 7/2012 |
| DE | 102013216974 | A1 | 4/2014 |
| DE | 102012223131 | A1 | 6/2014 |
| EP | 0577939 | A1 | 1/1994 |
| EP | 700820 | A2 | 3/1996 |
| EP | 579364 | B1 | 12/1997 |
| EP | 940316 | A2 | 9/1999 |
| EP | 1152201 | A1 | 11/2001 |
| EP | 1790250 | A2 | 5/2007 |
| EP | 1349802 | B1 | 8/2008 |
| EP | 1985205 | A1 | 10/2008 |
| EP | 2072937 | A2 | 6/2009 |
| EP | 2098810 | A2 | 9/2009 |
| EP | 2431688 | A1 | 3/2012 |
| EP | 2424421 | B1 | 10/2015 |
| EP | 2760315 | B1 | 8/2016 |
| EP | 3070424 | A1 | 9/2016 |
| EP | 2926069 | B1 | 11/2016 |
| EP | 3159635 | A1 | 4/2017 |
| EP | 3327390 | A1 | 5/2018 |
| ES | 2327831 | T3 | 11/2009 |
| IN | 201737009466 | | 8/2017 |
| JP | S54138061 | U | 9/1979 |
| JP | 52126461 | U | 9/1997 |
| JP | H110115485 | A | 5/1998 |
| JP | H110122733 | A | 5/1998 |
| JP | H111237173 | A | 8/1999 |
| JP | 2002090054 | A | 3/2002 |
| KR | 100364994 | B1 | 12/2002 |
| KR | 374557 | B1 | 3/2003 |
| KR | 20030061668 | A | 7/2003 |
| KR | 100431346 | B1 | 5/2004 |
| KR | 1020040070986 | | 8/2004 |
| KR | 20040095421 | A | 11/2004 |
| KR | 100559722 | B1 | 3/2006 |
| KR | 100756887 | B1 | 9/2007 |
| KR | 850005 | B1 | 8/2008 |
| KR | 2010026614 | A | 3/2010 |
| KR | 20100023474 | A | 3/2010 |
| KR | 20130015988 | A | 2/2013 |
| KR | 20130016997 | A | 2/2013 |
| KR | 20140022598 | A | 2/2014 |
| KR | 2017043815 | A | 4/2017 |
| WO | 02014761 | A1 | 2/2002 |
| WO | 2004104504 | A1 | 12/2004 |
| WO | 2005012812 | A1 | 2/2005 |
| WO | 2005100887 | A1 | 10/2005 |
| WO | 2007128734 | A1 | 11/2007 |
| WO | 2008015180 | A2 | 2/2008 |
| WO | 2009155679 | A2 | 12/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Protile_SideBySide.

* cited by examiner

REFRIGERATOR SHELVING FRAME WITH SNAP-IN SLIDING INSERT

BACKGROUND

The present device generally relates to a shelving arrangement for a refrigerator, and more specifically, to a shelving assembly wherein an insert can be assembled with a frame without deformation of the frame.

Various types of shelving assemblies for refrigerators may include a frame of a first material type, including plastic or the like, supporting an insert or substrate of a different material type, which may include glass, transparent plastic, or the like. Such arrangements may include various types and configurations of fixed or sliding inserts or substrates. In one aspect, a sliding insert of a substrate of glass or transparent plastic may be assembled in a supporting manner between opposite facing grooves in a separate frame. In some arrangements, the grooves may be longer than the insert such that sliding of the insert relative to the frame is facilitated. Some implementations of this and similar shelving assemblies may include closed tracks wherein flexing of the frame by an extent to temporarily deform the overall frame to expand the distance between the grooves to a distance greater that the corresponding dimension of the insert is required. Depending on the construction or materials used for the frame, such deformation may be difficult or may damage the frame itself during assembly of the shelf. Further, if removal of the insert is later needed, it may be similarly difficult to flex the frame sufficiently to be able to remove the insert. Accordingly, further advancements may be desired.

SUMMARY

In at least one aspect, a refrigerator shelf assembly includes a frame having a depth and a first support element extending along the depth and defining a first track open in a lateral direction perpendicular to the depth. The support element further defines a first open area along a first side of the track and extending between an adjacent portion of the track and an exterior of the first support element and a cantilever arm having a free end adjacent the first open area. The cantilever arm is resiliently deformable away from a plane defined along the first side of the track. The assembly further includes an insert slidably received within the track and moveable along the depth of the first track through a fixed range of motion, wherein the insert is disposed over an expanse of the first open area.

In at least another aspect, a refrigerator shelf assembly includes a frame having a depth and a first support element extending along the depth and defining a first track. A first open area extends between an adjacent portion of the track and an exterior of the first support element, and a resiliently deformable cantilever arm has a free end adjacent the first open area. The assembly also includes an insert configurable in an installed state, wherein the track is slideable along the track within an installed fixed range of motion less than a full length of the track, and in an assembly state, wherein movement thereof along the full length of the track is permitted. When in the assembly state, the insert is moveable through the first open area into and out of an assembly position wherein the back edge of the insert is in contact with the second end of the track by rotation of the insert generally about the back edge thereof under extension and flexing of the cantilevered portion.

In at least another aspect, a method for assembling a refrigerator shelf includes moving an insert portion of the refrigerator shelf through a first open area of a support element in a frame portion of the refrigerator shelf. The support element extends along a depth of the frame and defines a first track and a resiliently deformable cantilever arm having a free end adjacent the first open area such that moving the insert portion causes flexing of the cantilever arm and brings a back edge of the insert into contact with an end of the track. The method further includes rotating the insert generally about the back edge thereof under extension of the cantilevered portion into an assembly position wherein a front edge of the insert portion opposite the back edge is disposed over the open area and the insert is slidably received within the track. A trim piece is then assembled on a front edge the insert opposite the back edge. The insert restricts movement of the insert within the track to a fixed range of motion, wherein the front edge of the insert remains disposed away from the open area.

These and other features, advantages, and objects of the present device will be further understood and appreciated by those skilled in the art upon studying the following specification, claims, and appended drawings.

DETAILED DESCRIPTION OF EMBODIMENTS

Figure 1:
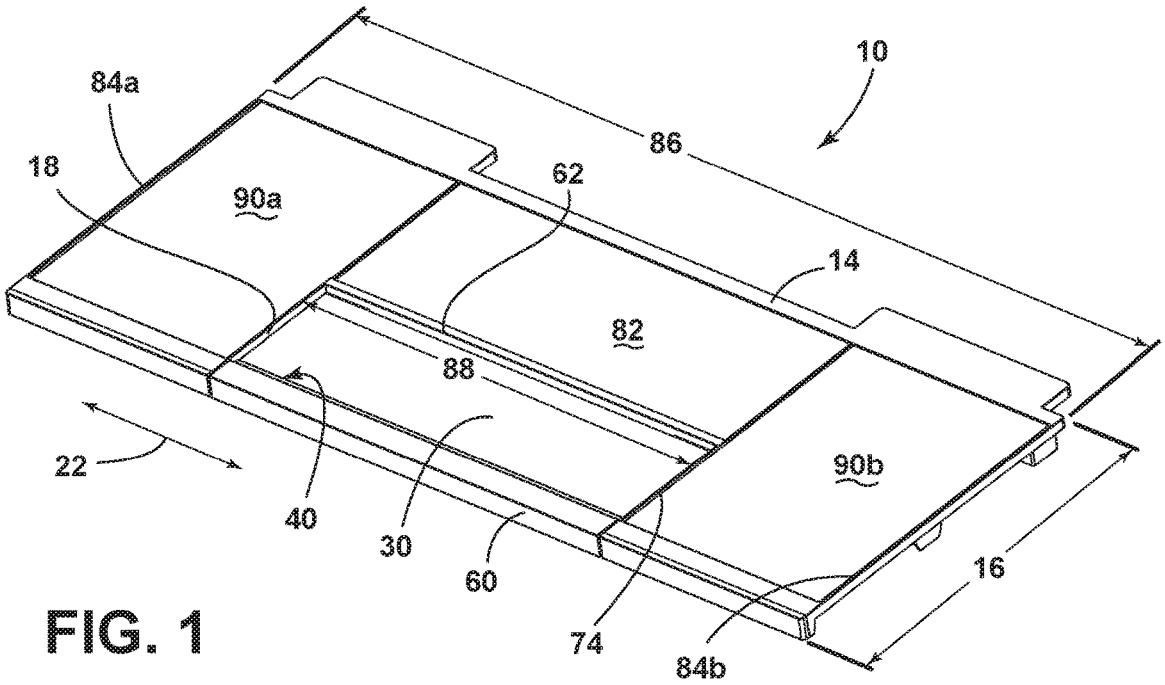
FIG. 1 is a top-front perspective view of a refrigerator shelving assembly.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
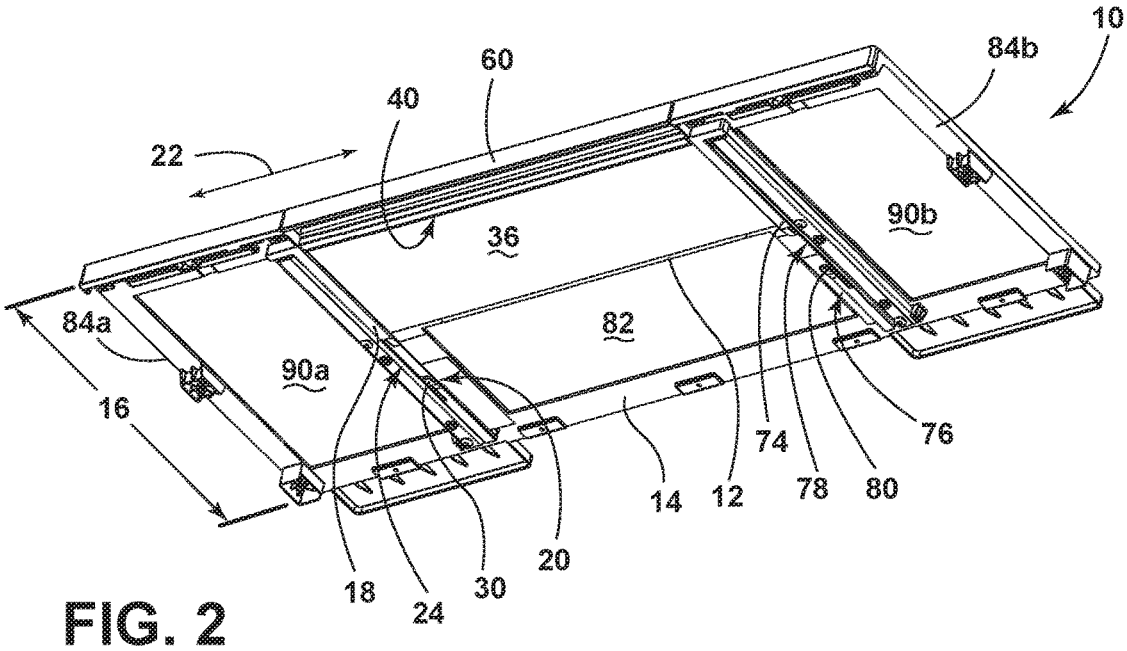
FIG. 2 is a bottom-front perspective view of the refrigerator shelving assembly.
Figure 3:
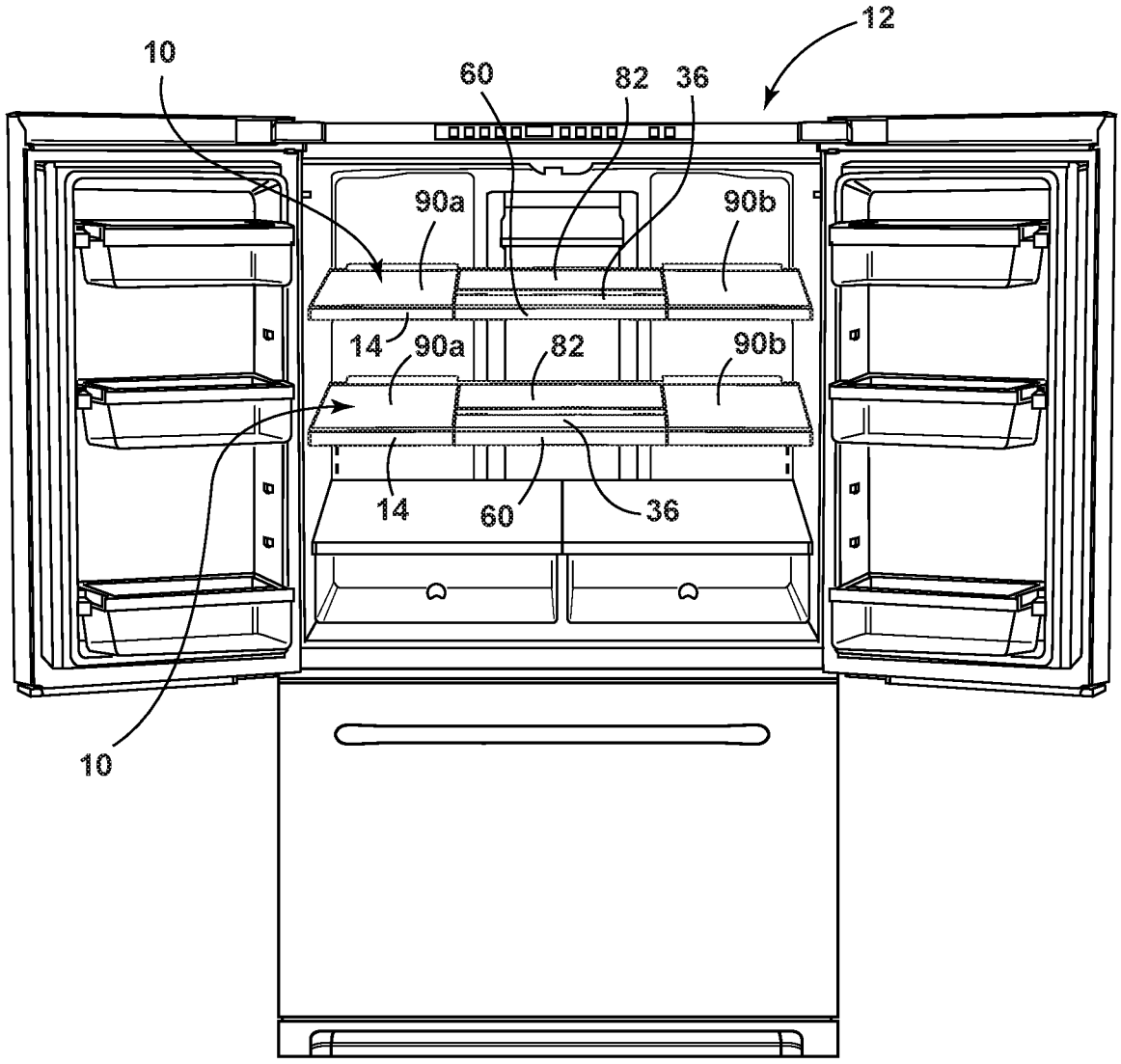
FIG. 3 is a front perspective view of multiple implementations of the refrigerator shelving assembly positioned within a refrigerator.

Referring to the embodiment illustrated in FIGS. 1-10, reference numeral 10 generally designates a shelf assembly for a refrigerator 12 (FIG. 3). Shelving assembly 10 includes a frame 14 having a depth 16 and a first support element 18 extending along the depth 16 and defining a first track 20 open in a lateral direction 22 perpendicular to the depth 16. The support element 18 also defines a first open area 24 along a first side 26 of the track and extending between an adjacent portion of the track (i.e., the track interior 28) and an exterior of the first support element 18. The first support element 18 includes a cantilever arm 30 having a free end 32 adjacent the first open area 24. The cantilever arm 30 is resiliently deformable away from a plane 34 defined along the first side 26 of the track. The shelf assembly also includes an insert 36 slidably received within the track 20 and moveable along the first track 20 through a fixed range of motion 38 such that a front edge 40 the insert 36 does not overlie an expanse 42 of the first open area 24.

As explained more fully herein, the above-described incorporation of the first open area 24 into first support element 18, defined by cantilever arm 30 and in communication with first track 20, can facilitate assembly of insert 36 with frame 14 and, if desired, removal of track 20 from frame 14. More specifically, the insert 36 may be assembled with track 20 by passing insert 36 through open area 24 by flexing of cantilever arm 30, which extends to maintain insert 36 within track 20. As discussed further below, the insert 36 is restricted to movement within the fixed range of motion 38 after such assembly to maintain insert 36 in a position where front edge 40 of insert 36 does not move into a position aligned with open area 24 to prevent subsequent removal of insert 36, including by inadvertent movement of insert 36 back out through open area 24. The incorporation of cantilever arm 30 allows for localized flexing of frame 14 for reliable assembly of insert 36 with frame 14, including in a manner that provides positive feedback confirming proper installation, without requiring general flexing or deformation of frame 14 to capture insert 36 within track 20 and within frame 14 overall, as discussed further below.

Figure 4:
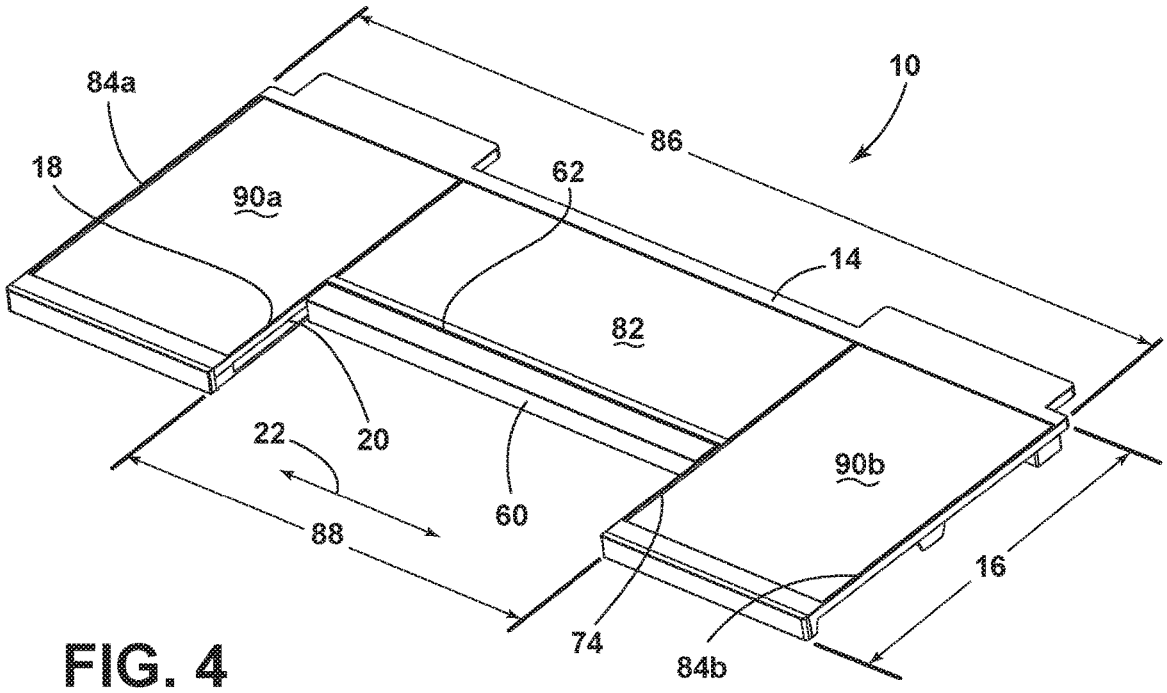
FIG. 4 is a top-front perspective view of the refrigerator shelving assembly with an insert thereof in a tucked position.
Figure 5:
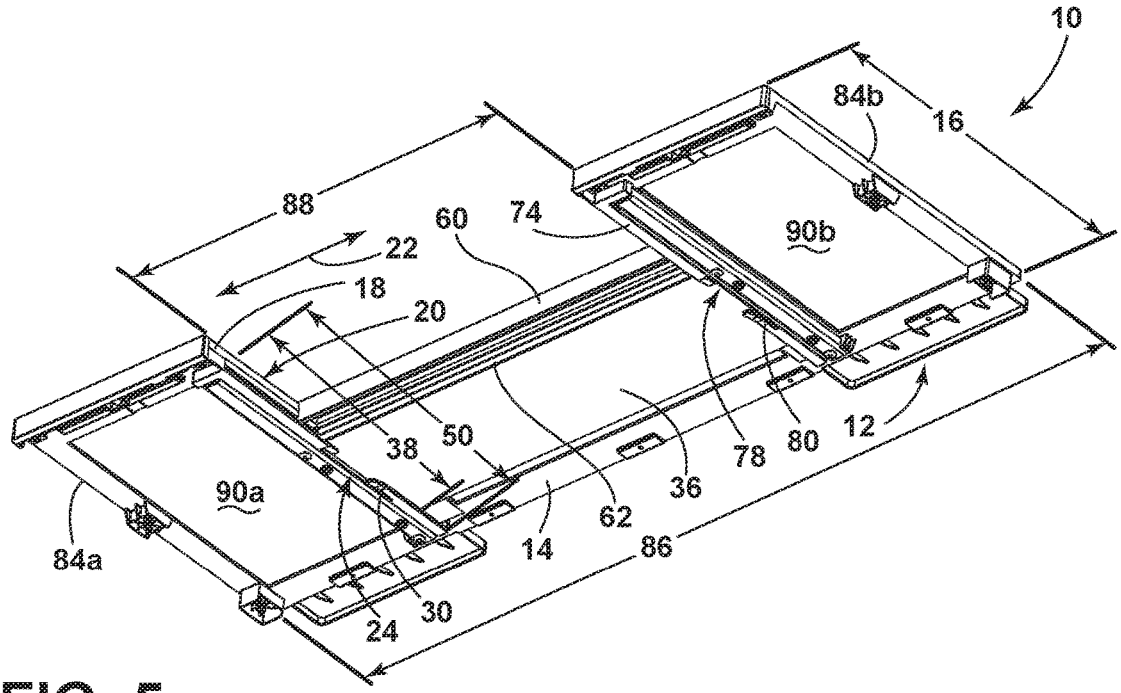
FIG. 5 is a bottom-front perspective view of the refrigerator shelving assembly with the insert in the tucked position.

As can be seen in FIGS. 4 and 5, in particular, the first track 20 includes opposite first 44 and second 46 closed ends defining a length 50 of the track 20. The fixed range of motion 38 of the insert 36 allows movement of the insert 36 into an extended position (as shown in FIGS. 1 and 2), wherein the front edge 40 of the insert 36 is adjacent the forward end 44 of the track 20, and an opposite back edge 48 of the insert 36 is remote from the rearward end 46 of the first track 20. On the opposite end of the fixed range of motion 38, the insert 36 is moveable into a tucked position (shown in FIGS. 3, 4, and 6), wherein the front edge 40 of the insert 36 is spaced from a forward end 44 of the track 20 and the back edge 48 of insert 36 moves closer to, but remains spaced from a rearward end 46 of the first track 20, the forward end 44 and the rearward end 46 defining opposed closed ends of track 20. In particular, the front edge 40 of the insert 36 may move away from the forward end 44 of the first track 20 by a distance about equal to a distance between the front 40 and back 48 edges of the insert 36. In one aspect, such movement of insert 36 can allow for the overall configuration of the shelving assembly 10 to be changed with insert 36 moveable outward for storing of articles thereon, or moveable inward to allow for taller articles to be stored in a position beneath shelving assembly 10 and extending into or through an area otherwise occupied by insert 36.

Figure 6:
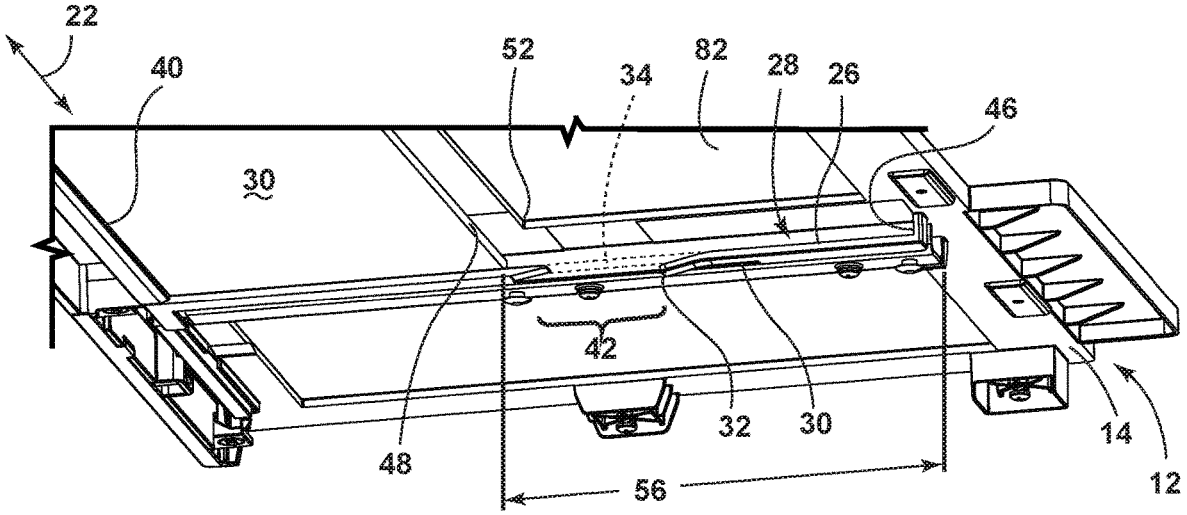
FIG. 6 is a bottom perspective detail view of the refrigerator shelving assembly of FIG. 2.
Figure 7:
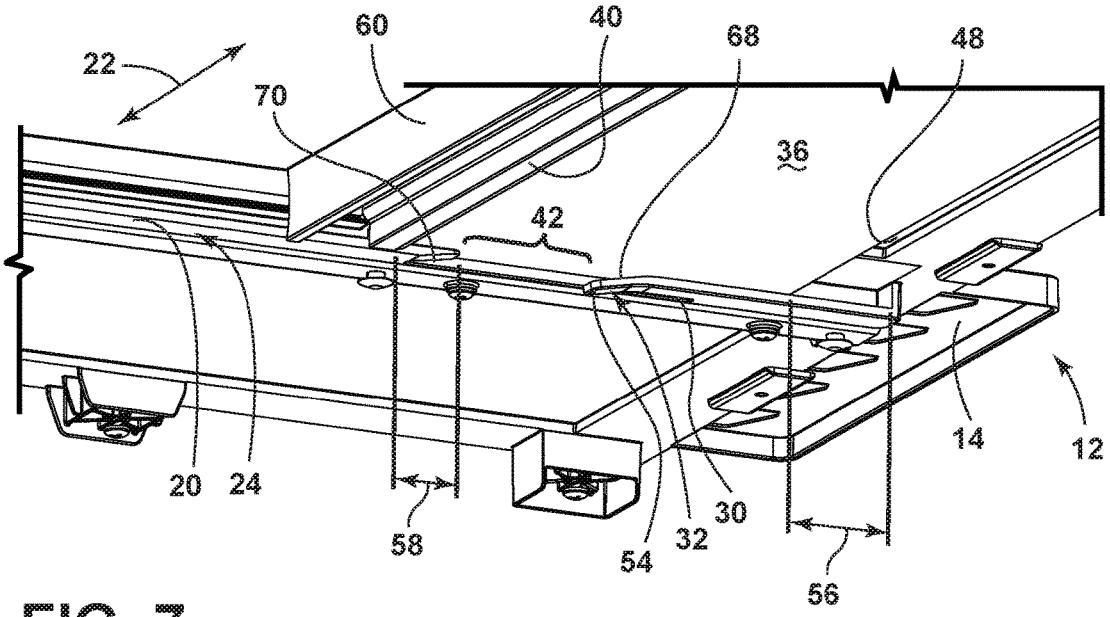
FIG. 7 is a bottom perspective detail view of the refrigerator shelving assembly of FIG. 5.

As discussed above, shelving assembly 10 is configured to provide for improved assembly of insert 36 with frame 14 through localized deformation of frame 14 within cantilevered arm 30, while preventing inadvertent removal of insert 36. As discussed above, such inadvertent removal may be prevented by configuring shelving assembly 10 such that the insert is restricted to the fixed range of motion 38 to maintain the front edge 40 in a position forward of the first open area 24. As shown in FIGS. 5-7, the first open area 24 is defined between fixed edge 52 and an opposite free edge 54 defined on the free end 32 of the cantilevered arm 30, the fixed edge 52 of the open area 24 is disposed toward the forward end 44 of the track 20, and the free edge 54 is disposed toward the rearward end 46 of the track 20. In this manner, a first distance 56 between the back edge 48 of the insert and the rearward end 46 of the first track 20 remains greater than a second distance 58 between the front edge 40 of the insert 36 and the fixed edge 52 of the first open area 24 throughout movement of the insert 36 in the fixed range of motion 38.

As discussed further below, this spacing allows for room within track 20 for insertion or removal of insert 36 through the open area 24 in support element 18, while restricting the movement of insert 36, once installed, to the fixed range of motion 38 prevents insert 36 from moving into a position (e.g., where the front edge 40 is within open area 24) where insert 36 can be removed from support element 18. In this manner, insert 36 is configurable in an "installed" state, wherein movement of insert 36 along the track 20 is restricted to movement within the fixed range of motion 38. Further, insert 36 may be further configurable in an "assembly" state (and, accordingly, alternately configurable between the installed and assembly states) such that assembly or intentional removal of insert 36 through open area 24 is possible. In the assembly state movement of the insert 36 along the entirety of the track 20 is permitted.

As shown in FIGS. 4, 5, and 7, a trim piece 60 is assembled over the front edge 40 of insert 36 and extends upwardly and downwardly from insert 36 to generally align in a thickness thereof with the first support element 18 and/or other adjacent portions of frame 14. As further shown, frame 14 further includes an intermediate support 62 extending from a portion of the first support element 18 generally perpendicularly thereto. As shown intermediate support 62 extends from support element 18 generally within a mid-portion thereof or from a "midpoint" that may not be exactly from a geometric middle of first support element 18 or the depth 16 of frame 14 but may be more generally from within the portion generally understandable as the described mid portion of frame 14. In one aspect, such a midpoint may be within a middle-third of the length of support element 18 and/or the depth 16 of frame 14 and may, further, coincide with the position of rear edge 48 of insert 36 when front edge 40 is in contact with the forward end 44 of track 20 such that support element 18 is positioned over or just to the front of rear edge 48 in such a position.

Intermediate support 62 may be further structured to be positioned generally above insert 36 and track 20 such that intermediate support 62 does not interfere with movement of insert 36 within the fixed range of motion 38. As would be understood, such an arrangement allows for sliding of insert 36 beneath intermediate support 62 within the fixed range of motion 38. However, because trim piece 60 extends upwardly from insert 36, trim piece 60 contacts the intermediate support 62 when insert 36 is moved along track 20 into the positions illustrated in FIGS. 4, 5, and 7 (i.e. wherein front edge 40 is increasingly moved away from the forward end 44 of track 20. In this manner, the contact of trim piece 60 with intermediate support 62 can define the rearward end of the fixed range of motion 38 with such contact preventing continued movement of back edge 48 toward the rearward end 46 of track 20 outside of the fixed range of motion 38, resulting in the above-described spacing 56 therebetween. In this manner, trim piece 60 can be removably installed or assembled with insert 36 such that the assembly of trim piece 60 can configure insert 36 in the installed state, wherein movement of insert 36 is restricted to the fixed range of motion 38. Further, the general absence or subsequent removal/disassembly of trim piece 60 from insert 36 can configure insert 36 in the assembly state such that insert 36 can be moved or otherwise positioned along track 20 outside of the fixed range of motion 38 to positions anywhere along the length of track 20 for installation or removal of insert 36 into or out of track 20 and support element 18.

Figure 8:
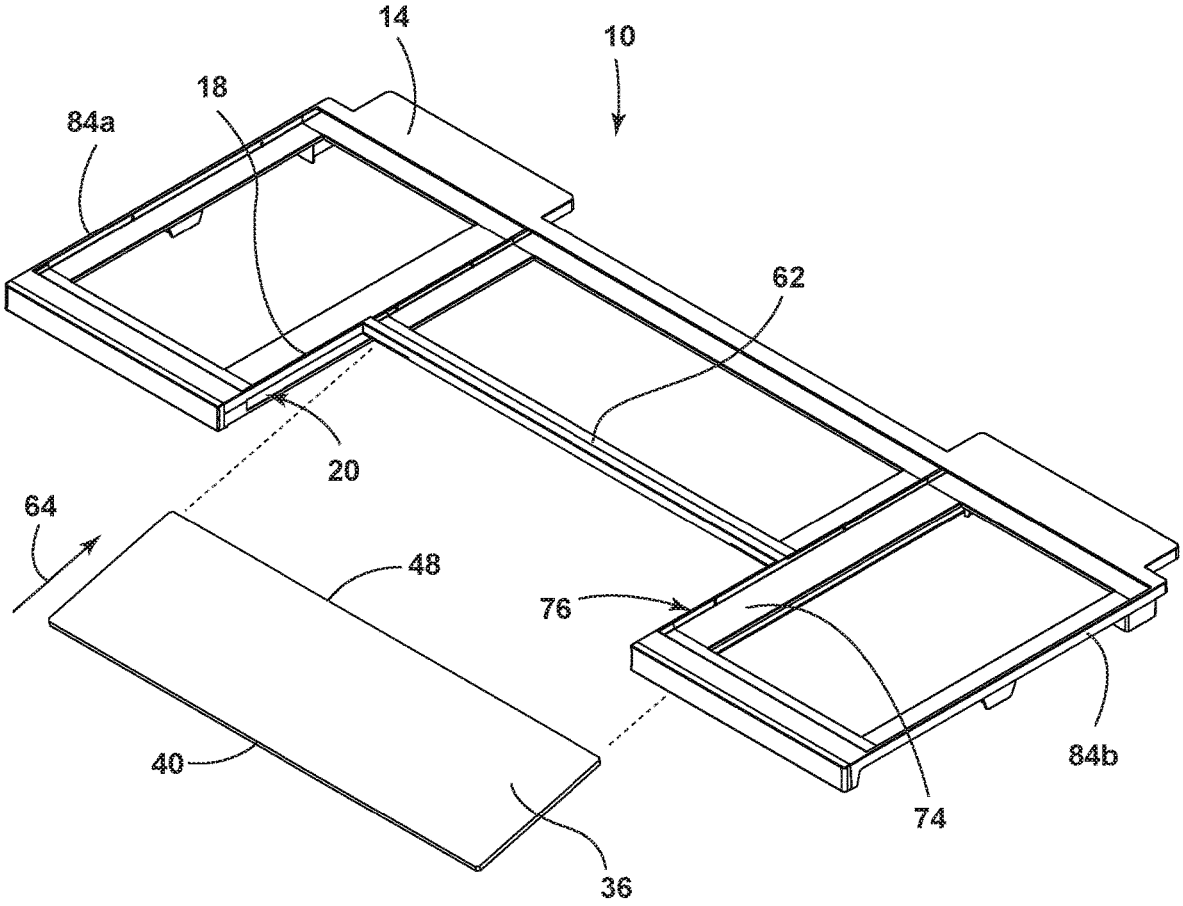
FIG. 8 is an exploded assembly view of the shelving assembly during a first assembly state.
Figure 9A:
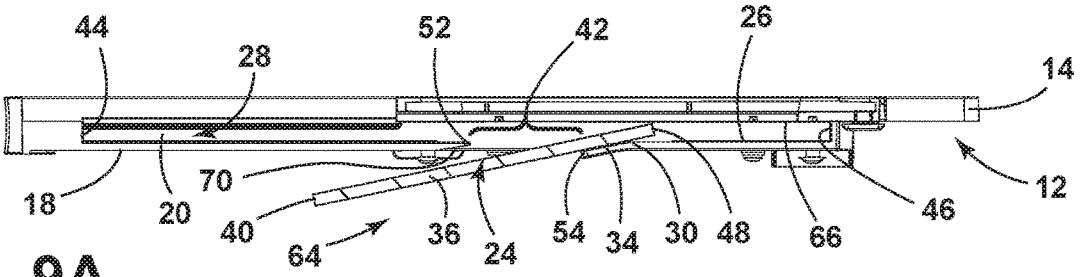
FIGS. 9A-9E are cross section views showing sequential steps for assembling the insert with respect to a frame of the shelving assembly.
Figure 9B:
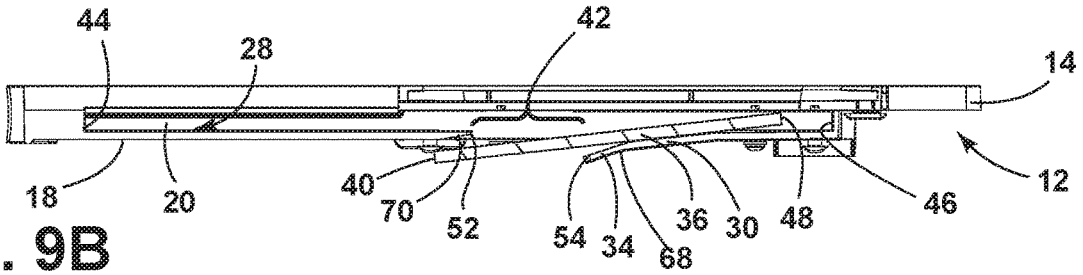
Figure 9C:
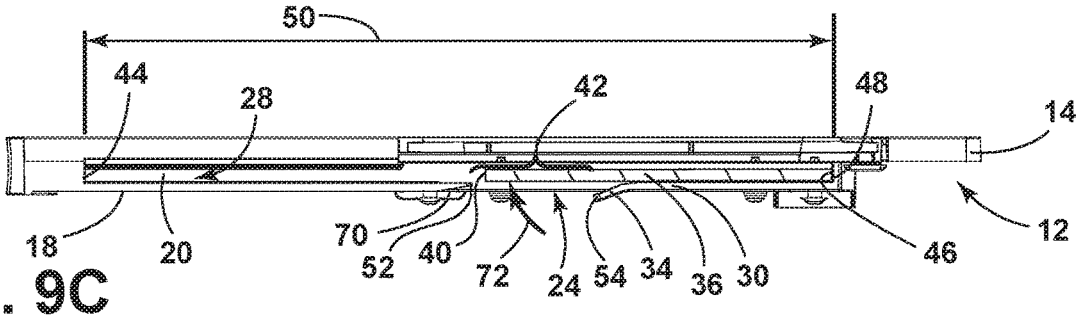
Figure 9D:
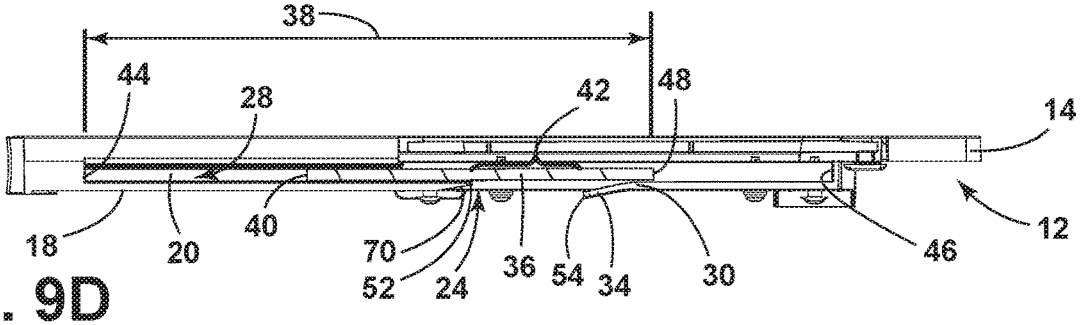
Figure 9E:
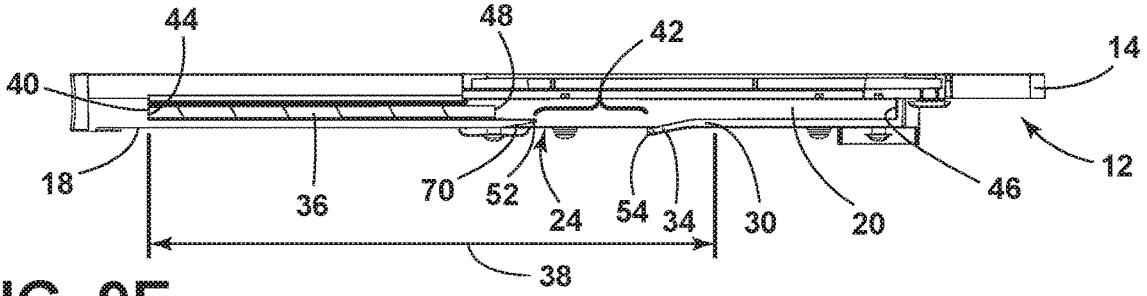

Turning to FIGS. 8 and 9A-9E, the movement of insert 36 along the entirety of track 20 when in the assembly state includes movement of the rear edge 48 of the insert 36 into contact with the rearward end 46 of the track 20, as shown in FIG. 9C. Due to the above-described positioning of the fixed edge 52 of open area 24 with respect to both the forward end 44 and rearward end 46 of track 20, the back edge 48 of insert 36 will be positioned in close proximity (e.g., within about 5 mm) or in actual contact with rearward end 46 of track for front edge 40 of insert 36 to be disposed within or above open area 24 (i.e. to be rearward of fixed edge 52). In this manner, configuration of insert 36 in the assembly state allows for the initial installation of insert 36 within track 20 to be supported by support element 18 in frame 14. As shown in FIG. 8, insert 36, thusly configured in the assembly state (e.g., without trim piece 60 assembled therewith), can be assembled with frame 14 by positioning insert 36 in an aligned manner with respect to open area 24 with insert 36 positioned generally below frame 14 (i.e. to correspond with the positioning of open area 24 on the bottom of track 20). Insert 36 can then be moved in direction 64 toward open area 24 such that back edge 48 of insert 36 passes through open area 24 and into a position within an adjacent portion of track 20, as shown in FIG. 9B.

In one aspect, the open area 24, as defined between the fixed edge 52 and the opposing edge 54 on the free end 32 of cantilever arm 30, can be less than a size actually realized for open area during installation of insert 36, which may be a product of the depth of insert 36 and the thickness thereof. In this manner, the described movement of insert 36 into and through the position shown in FIG. 9B can result in insert 36 simultaneously contacting an upper side 66 of track 20, the fixed edge 52 and the free edge 54 of open area before the front edge 40 of insert 36 clears the fixed edge 52 (and with back edge 48 still displaced from the rearward end 46 of track 20). In this arrangement, the structure of cantilever arm 30, which may defined as a tab or extended portion of the support element 18 on the first side 26 of track 20 that is relatively flexible and extends along track 20 in a suspended arrangement from the contiguous portion of support element 18, as shown in FIGS. 6 and 7. This configuration of cantilever arm 30 and the use of the edge 54 on the free end 32 thereof to define open area 24 means that cantilever arm 30 may be flexible to allow for expansion of open area 24 under a force applied on free end 32 under flexing of cantilever arm 30.

As shown in FIG. 9B, movement of insert 36 to force back edge 48 of insert 36 toward the rearward end 46 of track 20 can cause insert 36 to apply such pressure to free end 32, which can cause cantilever arm 30 to flex, as illustrated. This flexing of cantilever arm 30 can provide the needed configuration or manipulation of open area 24 for continued movement of insert 36 into a position where front edge 40 of insert 36 is aligned with open area 24 by being clear of the fixed edge 52. In one aspect, free end 32 of cantilever arm 30 can include a bent portion 68 that can provide a surface over which insert 36 can slide during such movement, which may prevent any increased friction or jamming from contact with an edge. Such a bent portion 68 can also provide a catch to facilitate alignment of back edge 48 of insert 36 with open area 24 during assembly thereof. In a similar manner, the fixed edge 52 of open area 24 can be defined on an upwardly sloped or ramp portion 70 of support element 18, which can provide another sliding surface for insert 36 during movement into and through the position of FIG. 9B.

Figure 10:
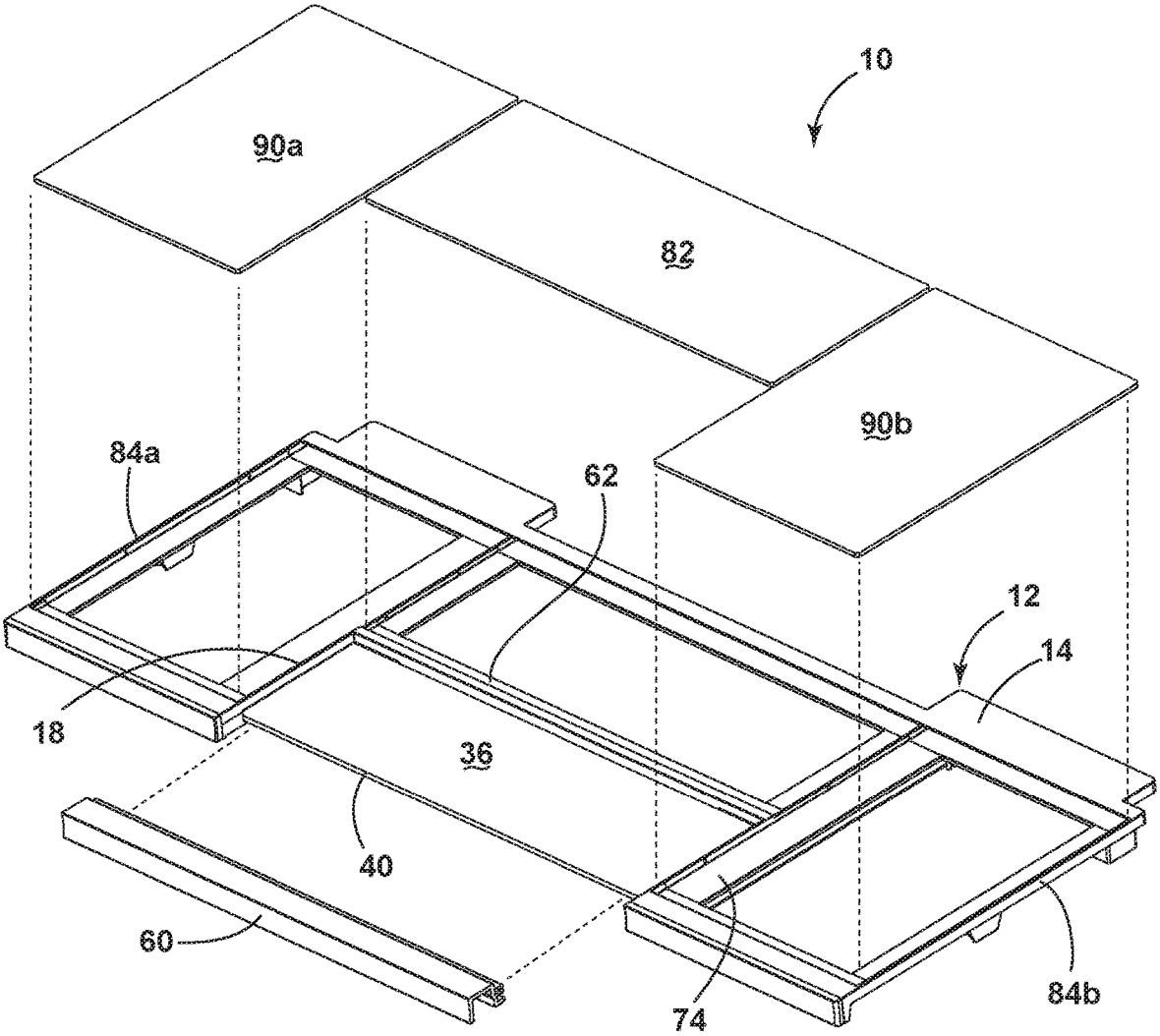
FIG. 10 is an exploded assembly view of the shelving assembly during a subsequent assembly state.

Continued movement of insert 36 through the position of FIG. 9B can result in insert 36 being positioned such that front edge 40 of insert 36 is aligned with open area 24 by being clear of the fixed edge 52. When such positioning has been achieved, back edge 48 of insert 36 will be proximate to or in contact with rearward end 46 of track 20 and insert 36 will be moveable into an aligned position within track 20, as shown in FIG. 9C, by upward rotation of insert 36 about back edge 48 in direction 72. In one aspect, the above-described flexing of cantilever arm 30 during earlier stages of assembly will displace cantilever arm 30 from its natural position such that, once front edge 40 is clear from fixed edge 52, cantilever arm 30 will extend back toward its natural position, thereby causing the upward rotation of insert 36 into the position of FIG. 9C in a snapping manner. In this arrangement, open area 24 will generally return to its original configuration and insert 36 may be supported in the aligned position within track 20 by cantilever arm 30. In this position, insert 36 may be slid forward along track 20 through the position shown in FIG. 9D, including into the fixed range of motion 38, and into the position shown in FIG. 9E. Subsequently, as shown in FIG. 10, trim piece 60 can be assembled onto front edge 40 of insert 36 (which can be done with insert positioned generally anywhere within the fixed range of motion 38) to configure insert 36 in the installed state.

In an aspect of the disclosure, a method for assembling the shelving assembly 10 discussed herein, can be in accordance with the steps shown in FIGS. 8, 9A-9E, and 10 and the corresponding description, above, and can include moving the insert 36 through open area 24 of support element 18, such support element 18, as discussed above, being within frame 14 of the shelving assembly 10. As also discussed above, the support element 18 extends along the depth 16 of the frame 14 and defines the above-described first track 20 and the resiliently deformable cantilever arm 30 having free end 32 adjacent the first open area 24. In this manner, moving the insert 36, ad described, causes flexing of the cantilever arm 30 and brings the back edge 48 of the insert 36 into contact with the rearward end 46 of the track 20. The method further includes rotating the insert 36, including as discussed above, generally about the back edge 48 thereof under extension of the cantilever arm 30 into an "assembly" position (i.e., the above-described aligned position of insert 36 within track 20) wherein the front edge 40 of the insert 36 is disposed over the open area 24 and the insert 36 is slidably received within the track 20. The method further includes assembling trim piece 60 on the front edge 40 the insert 36 opposite. The trim piece 60, when installed, restricts movement of the insert 36 within the track 20 to the above-discussed fixed range of motion 38 wherein the front edge 40 of the insert 36 remains disposed away from the open area 24.

If desired, insert 36 can be subsequently removed from frame 14 by first removing trim piece 60 (to configure insert 36 in the assembly state, followed by reversal of the above steps, wherein back edge 48 of insert 36 is moved into close proximity or contact with the rearward end 46 of track 20 and insert 36 is rotated downwardly (in a direction opposite direction 72) by flexing of cantilever arm 30 to move front edge 40 to a position outside of support element 18. Insert is then moved in a direction opposite the assembly direction 64 to slide insert 36 out through open area 24.

As further shown in the figures, insert 36 may be configured as a forward portion of what may be generally characterized as a "tuck shelf." In particular, insert 36 may be supported opposite from the support element 18 described above by a second support element 74 positioned laterally opposite support element 18 such that insert 36 extends between the support elements 18 and 74. In this manner, support element 74 can be configured in a similar manner to the support element 18, as described above, but as a mirror image thereof about a lateral midplane of shelving assembly 10. Accordingly, support element 74 can extend along depth 16 of frame 14 generally parallel to support element 18 and can include a second track 76 that is open toward the opposite track 20 such that insert 36 can be slidably supported therebetween. Further support element 74 can be configured with its own open area 78 and corresponding cantilever arm 80. In this manner, insert 36 can be assembled with support element 74 through open area 78 into track 76 in a similar manner to the assembly of insert 36 with support element 18. Further, such assembly of insert 36 (and/or subsequent removal) can be carried out simultaneously with both support elements 18 and 74 in the same process as discussed above. Further, assembly of trim piece 60 with insert 36 can configure insert 36 in the installed position with respect to both support elements 18,74 and can restrict movement of the insert 36 in the same fixed range of motion 38 with respect to both tracks 20 and 76.

As further shown in the figures, the above-described intermediate support 62 can extend between and perpendicular to both the first and second support elements 20,74 at the above-described midpoint along the depth 16 of the frame 14. In this manner, the shelving assembly 10 may further include a first substrate 82 supported on the intermediate support 26 and the first and second support elements 18,74 in a fixed position with respect to frame 14. In one aspect both the insert 36 and the first substrate 82 can be of a glass (including tempered glass, borosilicate glass, or the like, for example) or plastic, including transparent plastic (e.g., Lucite™, acrylic, Plexi-Glass™, or the like). In such an arrangement, movement of the insert 36 through the fixed range of motion 38 includes movement of the insert 36 into a "tucked" position (corresponding with the depictions of shelving assembly 10 in FIGS. 4 and 5), wherein the first substrate 82 overlies the insert 36 (i.e., insert 36 is positioned beneath substrate 82). Further, movement of insert 36 to the opposite end of the fixed range of motion 38 (i.e. with the front edge 40 of insert 36 in contact with the forward end 44 of track 20) positions insert 36 in an extended position (shown in FIGS. 1 and 2), wherein the insert 36 extends in a portion of the depth 16 of frame 14 that is outside of or beyond the first substrate 82. In this manner, each of the insert 36 and the shelf can extend through corresponding portions or divisions of the depth 16 of frame 14, as shown in the figures.

Still further, the shelving assembly 10 described herein may be a U-Shaped tuck shelf, wherein frame 14 further defines first and second lateral elements 84*a*,84*b* spaced outwardly from and generally parallel with the first and second support elements 18,74 through the depth 16 of the frame 14. The first and second lateral elements 84*a*,84*b* can be spaced apart from each other to define width 86 of the frame 14 that is greater than a distance 88 between the first and second support elements 18,74. The shelving assembly 10 can further include second and third substrates 90*a*,90*b* with the second substrate 90*a* being positioned in an area between the first lateral element 84*a* and the first support element 18 and the third substrate 90*b* being positioned in an area between the second lateral element 84*b* and the second support element 74. As shown, both the second and third substrates 90*a*,90*b* extend through a majority of the depth 16 of the frame 14. The second and third substrates 90*a*,90*b* can be of any of the materials discussed above with respect to the insert 36 and the first substrate 82, wherein the assembly 10 may include a combination of various different such materials among the insert 36 and the first, second, and third substrates 82,90*a*,90*b*.

By the described arrangement, the shelving assembly 10 takes on a U-shape, particularly when insert 36 is in the tucked position beneath substrate 82. The incorporation of the open areas 24 partially defined by cantilever arms 30, which facilitate assembly of insert 36 with frame 14 without deformation thereof may be of particular use in such an arrangement, as the additional frame elements (including lateral elements 84*a*,84*b* and intermediate support 62) may add to the overall rigidity of frame 14 making deflection thereof to a degree to assemble insert 36 between the support elements 18,74 difficult. As further shown in FIG. 10, the assembly of shelving assembly 10 can also include positioning of the substrates 82,90*a*,90*b* within the respective portions of frame 14, which can be done, for example, after assembly of insert 36 with frame 14.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator shelf assembly, comprising:

a frame having a depth, a first support element extending along the depth and opposite first and second closed ends defining a length of the first track, the first support element further defining a first track open in a lateral direction perpendicular to the depth, the support element further defining a first open area along a first side of the support element perpendicular to the lateral direction and the depth and extending between an adjacent portion of the first track and an exterior of the first support element and a cantilever arm having a free end adjacent the first open area, the cantilever arm being resiliently deformable away from a plane defined along the first side of the first support element; and an insert slidably received within the first track and moveable along the plane in a direction of the depth of the first track through a fixed range of motion wherein the insert is disposed over an entirety of the first open area within at least a portion of the fixed range of motion, the fixed range of motion of the insert being defined between an extended position, wherein a front edge of the insert is adjacent the first end of the first track and a back edge of the insert is remote from the second end of the first track, and a tucked position, wherein the front edge of the insert is spaced from the first end of the first track by a first distance equal to a second distance between the front and back edges of the insert and the back edge of the insert is spaced from the second end of the first track.

2. The shelf assembly of claim 1, wherein:

the first open area is defined between a front edge and a back edge defined on a free end of the cantilever arm, the front edge being disposed toward the first end of the first track and the back edge being disposed toward the second end of the first track; and a first distance between the back edge of the insert and the second end of the first track is greater than a second distance between the front edge of the insert and the front edge of the first open area throughout the fixed range of motion of the insert.

3. The shelf assembly of claim 1, wherein:

the insert is configurable in an installed state, wherein movement thereof along the first track is restricted to movement within the fixed range of motion; and the insert is further configurable in an assembly state, wherein movement thereof along the entirety of the first track is permitted.

4. The shelf assembly of claim 3, wherein movement along the entirety of the first track includes movement of the back edge of the insert into contact with the second end of the first track.

5. The shelf assembly of claim 3, wherein the insert is alternately configurable in the installed state and the assembly state by a trim piece being assembled or disassembled with the front edge of the insert.

6. The shelf assembly of claim 5, wherein:

the frame further includes an intermediate support extending from midpoint of the first support element perpendicularly thereto; and the trim piece contacts the intermediate support when installed on the insert in the tucked position to restrict movement of the insert to within the fixed range of motion.

7. The shelf assembly of claim 3, wherein when in the assembly state, the insert is moveable through the first open area into and out of an assembly position wherein the back edge of the insert is in contact with the second end of the first track.

8. The shelf assembly of claim 7, wherein the insert is moveable through the first open area into and out of the assembly position by rotation of the insert generally about the back edge thereof under extension and flexing of the cantilever arm.

9. A refrigerator shelf assembly, comprising:

a frame having a depth and a first support element extending along the depth and defining a first linear track, a first open area extending between an adjacent portion of the first track and an exterior of the first support element, and a resiliently deformable cantilever arm having a free end adjacent the first open area; and an insert the insert configurable in an installed state, wherein the first track is slideable along the first track within an installed fixed range of motion less than a full length of the first linear track, and in an assembly state, wherein movement thereof along the full length of the first linear track along a horizontal plane is permitted;

wherein when in the assembly state, the insert is moveable through the first open area into and out of an assembly position wherein the back edge of the insert is in contact with the second end of the first track by rotation of the insert generally about the back edge thereof under extension and flexing of the cantilever arm.

10. The shelf assembly of claim 9, wherein the insert is alternately configurable in the installed state and the assembly state by a trim piece being assembled or disassembled with the front edge of the insert.

11. The shelf assembly of claim 10, wherein:

the frame further includes an intermediate support extending from midpoint of the first support element perpendicularly thereto; and the trim piece contacts the intermediate support when installed on the insert in the tucked position to restrict movement of the insert to within the fixed range of motion.

12. The shelf assembly of claim 9, wherein the support element is a first support element, the open area is a first open area, and the frame further includes:

a second support element opposite the first support element and extending along the depth generally parallel with the first support element, the second support element defining a second first track facing the first track; and an intermediate support extending between the first and second support elements perpendicular thereto and spaced at a midpoint along the depth of the frame; and the assembly further includes a first substrate supported on the intermediate support and the first and second support elements in a fixed position.

13. The shelf assembly of claim 12, wherein movement of the insert, when in the installed state, through the fixed range of motion includes movement of the insert into a tucked position, wherein the first substrate overlies the insert and an extended position, wherein the insert extends in a portion of the depth outside of the first substrate.

14. The shelf assembly of claim 13, wherein the frame further defines first and second lateral elements spaced outwardly from and generally parallel with the first and second support elements through the depth of the frame, the first and second lateral elements defining a width of the frame that is greater than a distance between the first and second support elements, the assembly further including:

second and third substrates, the second substrate being positioned in an area between the first lateral element and the first support element and the third substrate being positioned in an area between the second lateral element and the second support element, both the second and third substrates extending through a majority of the depth of the frame.

15. The shelf assembly of claim 9, wherein, when the insert is in the installed state, the insert is disposed over an expanse of the first open area throughout sliding of the insert along the first track within the fixed range of motion.

16. A refrigerator shelf assembly, comprising:

a frame defining a depth and including:

a first support element extending along the depth and defining a first track open in a lateral direction perpendicular to the depth, the support element further defining a first open area along a first side of the support element perpendicular to the lateral direction and the depth and extending between an adjacent portion of the first track and an exterior of the first support element and a cantilever arm having a free end adjacent the first open area, the cantilever arm being resiliently deformable away from a plane defined along the first side of the first support element;

a second support element opposite the first support element and extending along the depth generally parallel with the first support element, the second support element defining a second track open in the lateral direction and facing the first track; and an intermediate support extending between the first and second support elements perpendicular thereto and spaced at a midpoint along the depth of the frame;

a first substrate supported on the intermediate support and the first and second support elements in a fixed position; and an insert slidably received within the first track and moveable along the plane in a direction of the depth of the first track through a fixed range of motion wherein the insert is disposed over an entirety of the first open area within at least a portion of the fixed range of motion, wherein movement of the insert through the fixed range of motion includes movement of the insert into a tucked position, wherein the first substrate overlies the insert and an extended position, wherein the insert extends in a portion of the depth outside of the first substrate.

17. The shelf assembly of claim 16, wherein the frame further defines first and second lateral elements spaced outwardly from and generally parallel with the first and second support elements through the depth of the frame, the first and second lateral elements defining a width of the frame that is greater than a distance between the first and second support elements, the assembly further including:

second and third substrates, the second substrate being positioned in an area between the first lateral element and the first support element and the third substrate being positioned in an area between the second lateral element and the second support element, both the second and third substrates extending through a majority of the depth of the frame.

* * * * *